US007585189B2

(12) United States Patent
Wu et al.

(10) Patent No.: US 7,585,189 B2
(45) Date of Patent: Sep. 8, 2009

(54) ELECTRICAL CONNECTOR

(75) Inventors: Hongbin Wu, Shenzhen (CN); Dong Yang, Shenzhen (CN); Wei Fang, Shenzhen (CN); Fengwei Tian, Shenzhen (CN); Facan Feng, Shenzhen (CN)

(73) Assignee: Huawei Technologies Co., Ltd., Shenzhen, P.R. (CN)

( * ) Notice: Subject to any disclaimer, the term of this patent is extended or adjusted under 35 U.S.C. 154(b) by 379 days.

(21) Appl. No.: 11/596,781

(22) PCT Filed: Jun. 28, 2006

(86) PCT No.: PCT/CN2006/001486

§ 371 (c)(1),
(2), (4) Date: Nov. 15, 2006

(87) PCT Pub. No.: WO2007/000116

PCT Pub. Date: Jan. 4, 2007

(65) Prior Publication Data

US 2008/0268707 A1 Oct. 30, 2008

(30) Foreign Application Priority Data

Jun. 29, 2005 (CN) ..... 2005 2 0060902 U

(51) Int. Cl.
*H01R 24/00* (2006.01)

(52) U.S. Cl. ..... 439/660; 439/362; 439/79; 439/874

(58) Field of Classification Search ..... 439/660, 439/79, 874, 607, 362

See application file for complete search history.

(56) References Cited

U.S. PATENT DOCUMENTS

| | | | | |
|---|---|---|---|---|
| 5,244,420 | A | 9/1993 | Lopata et al. | 439/699.1 |
| 6,036,549 | A | 3/2000 | Wulff et al. | 439/660 |
| 6,042,425 | A * | 3/2000 | Moller et al. | 439/638 |
| 6,247,970 | B1 | 6/2001 | Ueno et al. | 439/608 |
| 6,287,148 | B1 | 9/2001 | Huang | 439/610 |
| 6,524,119 | B2 * | 2/2003 | Kato et al. | 439/79 |
| 6,582,244 | B2 * | 6/2003 | Fogg et al. | 439/362 |
| 6,669,514 | B2 | 12/2003 | Wiebking et al. | 439/701 |
| 6,685,485 | B2 * | 2/2004 | Korsunsky et al. | 439/79 |
| 2005/0014418 | A1 * | 1/2005 | Ji et al. | 439/660 |
| 2008/0132111 | A1 * | 6/2008 | Wu et al. | 439/491 |

FOREIGN PATENT DOCUMENTS

| | | | |
|---|---|---|---|
| CN | 1489812 | A | 4/2004 |
| EP | 1 032 087 | A | 8/2000 |
| NL | 1 012 345 | C2 | 12/2000 |
| WO | 89/11169 | A | 11/1989 |
| WO | 02/061883 | A2 | 8/2002 |

* cited by examiner

*Primary Examiner*—Tho D Ta
(74) *Attorney, Agent, or Firm*—Ladas & Parry LLP

(57) ABSTRACT

The present invention relates to a high density connector plug, comprising the body of plug and a plastic enclosure for fixing said body of plug and being connected with the cable. Said body of plug comprises a shielding shell, an insulator mounted in said shielding shell, and a set of contacts provided on the side of said insulator; said insulator comprising a base and upper plastic body and lower plastic body extending outwards from one side of said base, which have slots for mounting said contacts. Thus the interface footprint of plug and socket is reduced and the pin density is increased, thereby the volume of the corresponding device is significantly reduced, so that the devices have a trend towards miniature and high density. In addition, there is a stepped welding area provided on the insulator, so that the contacts can be connected to the cable by welding, and there is visibility in the cable welding, thereby the working efficiency is improved.

9 Claims, 8 Drawing Sheets

ELECTRICAL CONNECTOR

FIELD OF THE INVENTION

The present invention relates to connector technique in electronic or communication field, especially to a connector plug.

BACKGROUND OF THE INVENTION

In an existing data communication system, user terminals usually perform data communication with line equipment in the nearest exchange office through subscriber line and signal line, and the connector connected with data cable or communication cable serves as the interface of the subscriber line and the interface of the signal line to achieve signal transmission.

For an Asymmetric Digital Subscriber Line (ADSL), for example, the access equipment usually comprises two parts: Digital Subscriber Line Amplitude Module (DSLAM) and Remote Transceiver Unit (RTU) at subscriber side. As the equipment at office end, DSLAM performs functions of ADSL, such as transmitting/receiving, encoding/decoding, bandwidth multiplexing, and system maintenance and management, etc.; as the equipment at remote end, RTU provides an access port, including ordinary telephone interface, to the subscriber. On the equipment at office end, a connector interface is used to provide subscriber line interface to implement connection between the subscriber line and the equipment at office end.

An existing connector commonly used as a connector for subscriber line interface are a double-edged connector with a spacing of 2.17 mm, comprising a connector plug and a connector socket. FIG. 1 is an end view of a connector plug 10, which comprises metal interface portion 11, insulator 12 provided in said interface portion 11, contacts 13 evenly distributed on both sides of said insulator 12, plastic enclosure 14 connecting data cable and metal interface portion 11, and fixing screws 15 for connectively fixing the entire plug to a socket.

The profile of said metal interface portion 11 is in isosceles trapezoid shape, with the four corners of the trapezoid-shaped shell being rounded, like a inverted letter "D"; the trapezoid-shaped shell matches a female socket 30 (as shown in FIG. 2) to prevent misplugging. Said plastic insulator 12 appears as a band-shaped protrusion at the center inside of said interface portion 11, with slots that can accommodate said contacts 13 provided on both sides thereof. Said contacts 13 are provided in said slots, with a spacing of 2.16 mm between two adjacent contacts. In a connector with 64 contacts, for example, the connector is 98.43 mm (L)*15.37 mm (W), and the footprint of each pair of contacts is 47.28 $mm^2$. A connector with a plug of such structure is large in entire volume, with large footprint of interface and low pin density of the contacts.

In addition, said data cable is electrically connected with said contacts 13 by passing through said plastic enclosure 14; the connection is usually achieved through press fit, i.e., there is a knife-edge provided at the end of the contact near the cable, and when assembling, the cable is pressed into the knife-edge with a tool, so that the electrical connection between the cable and the contact is achieved. However, if the cable and the contact are connected by such a press fit method, the contact is often caused to be warped, thereby affecting contact reliability. Meanwhile, connection between the contact and the cable can not be achieved by welding, thereby limiting the use of the connector.

SUMMARY OF THE PRESENT INVENTION

An embodiment of the present invention provides a connector plug with small interface footprint and high pin density.

A further embodiment of the present invention provides a connector plug that can be connected with the cable by welding and make the cable welding visible.

According to an embodiment of the present invention, a high density connector plug comprises the body of plug and a plastic enclosure for fixing said body of plug and being connected with the cable; said body of plug comprising a shielding shell, an insulator mounted in said shielding shell, and a set of contacts provided on the side of said insulator; said insulator comprising a base and upper plastic body and lower plastic body extending outwards from one side of said base; slots for mounting said contacts being provided on the upper and lower surfaces of said upper plastic body and lower plastic body respectively.

Said insulator of said high density connector plug also comprises a stepped welding area extending outwards from the other side of said base; there are mounting grooves communicating with the slots at said upper plastic body and lower plastic body provided on the surface of said welding area.

Said welding area of said high density connector plug has a first plastic body extending outwards from said base and a second plastic body extending outwards from said first plastic body, provided in a stepped-shape; said mounting grooves comprise a plurality of first mounting grooves provided on the upper surface of said first plastic body and communicating with the slots at the upper surface of said upper plastic body, a plurality of second mounting grooves provided on the upper surface of said second plastic body and communicating with the slots at the lower surface of said upper plastic body, a plurality of third mounting grooves provided on the lower surface of said second plastic body and communicating with the slots at the upper surface of said lower plastic body, and a plurality of fourth mounting grooves provided on the lower surface of said first plastic body and communicating with the slots at the lower surface of said lower plastic body; there are insulating spacers provided between said mounting grooves, respectively.

Said set of contacts of said high density connector plug comprise a plurality of short contacts mounted in said first mounting grooves and fourth mounting grooves, as well as a plurality of long contacts mounted in said second mounting grooves and third mounting grooves.

Said short contact of said high density connector plug comprises front contact portion provided in a slot at the upper surface of said upper plastic body or the lower surface of said lower plastic body, middle portion passing through the base of said insulator, welding portion provided in a mounting groove at said welding area, and flanged edge extending upwards from a side of said welding portion and higher than said insulating spacer; the flanged edges of said plurality of short contacts mounted in said first mounting grooves are arranged in the same orientation; the flanged edges of said plurality of short contacts mounted in said fourth mounting grooves are arranged in the same orientation.

The contact portion of said short contact in said high density connector plug has a guide chamfer at its front end.

Said long contact of said high density connector plug comprises front contact portion provided in a slot at the lower surface of said upper plastic body or the upper surface of said lower plastic body, middle portion passing through the base of said insulator, welding portion provided in a mounting groove at said welding area, and flanged edge extending upwards from a side of said welding portion; the flanged edges of said plurality of long contacts mounted in said second mounting grooves are arranged in the same orientation; the flanged edges of said plurality of long contacts mounted in said third mounting grooves are arranged in the same orientation.

The contact portion of said long contact in said high density connector plug has a guide chamfer at its front end.

Said upper plastic body of said high density connector plug is shorter than said lower plastic body; and, said upper and lower plastic bodies are in symmetry with reference to the center line, respectively.

Said shielding shell of said high density connector plug comprises a rear metal shell mounted in said plastic enclosure and a front metal shell provided at the front end of said plastic enclosure; said front metal shell has a round protrusion provided on its inner wall.

Compared to the prior art, there are upper and lower plastic bodies provided on the insulator of the high density connector plug according to the present invention, so that the footprint of the interfacing portion of plug and socket is reduced and the pin density is increased; therefore, the volume of the corresponding device is reduced significantly, so that the device can have a trend towards miniature and high density. In addition, there is a stepped welding area provided on the insulator, so that the contacts can be connected with the cable by welding, and the cable welding is visible, thereby the working efficiency is improved; the design of long and short contacts can facilitate assembling in the insulator; the flanged edge design of the welding area of the contacts and the cable, in conjunction with the pull-welding processing method that can accomplish the welding with a single action, is advantageous to improve welding efficiency and prevent the solder from flowing.

DETAILED DESCRIPTION OF THE EMBODIMENTS

Hereunder a high density connector plug according to an embodiment of the present invention is further described in detail, with reference to the attached drawings.

Figure 1:
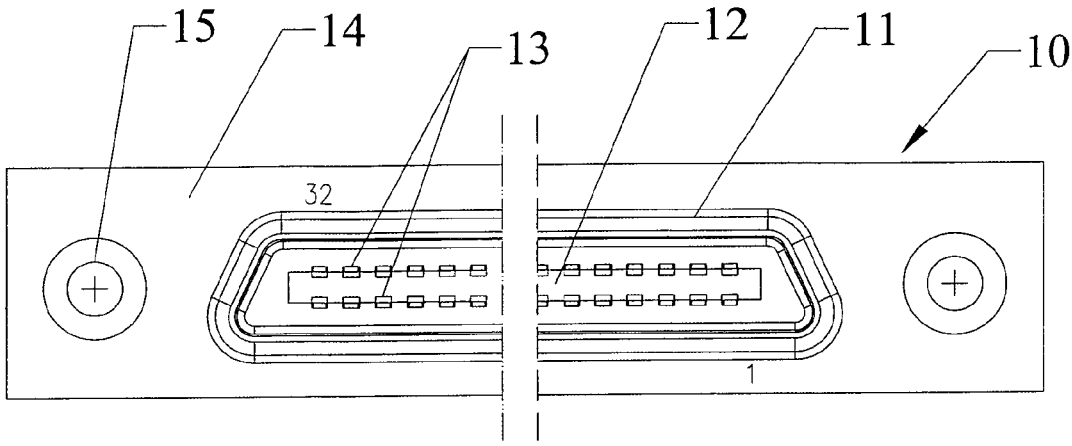
FIG. 1 is an end view of the plug of a double-edged connector in the prior art.
Figure 2:
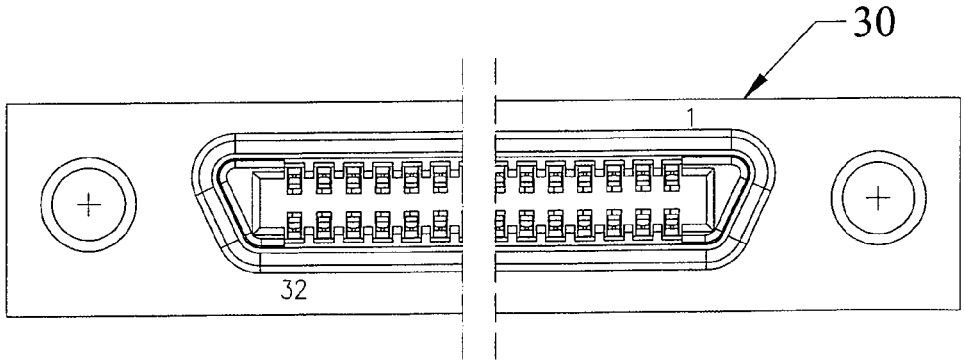
FIG. 2 is an end view of the socket in a double-edged connector in the prior art.
Figure 3:
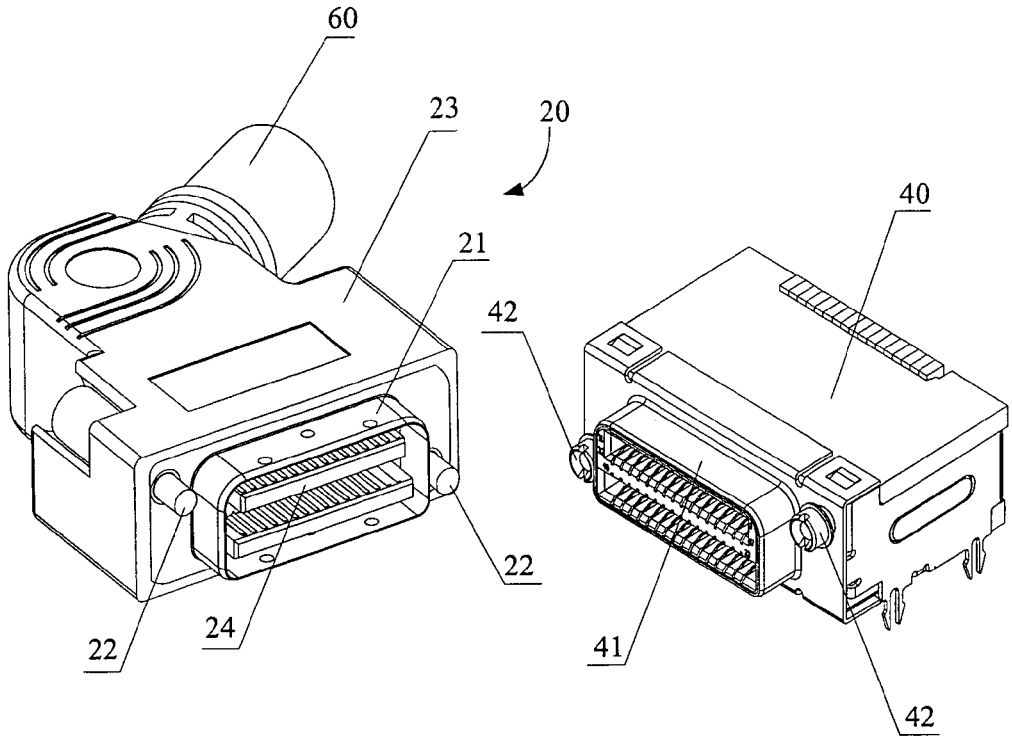
FIG. 3 is a stereogram of the plug and the socket in a high density connector according to an embodiment of the present invention.

As shown in FIG. 3, the connector comprises connector plug 20 and connector socket 40. The connector plug 20 can be used to connect with data cable 60 with multiple twisted pairs; and the connector socket 40 can be used to connect with a PCB (not shown). Both the connector plug 20 and the connector socket 40 are completely shielded at the interfacing portion; wherein, the connector plug 20 is shielded by the shielding shell 21 of the plug, and the connector socket 40 is shielded by the metal shell 41 of the socket. The connector plug 20 and the connector socket 40 match with each other in interface; when the connector plug 20 and the connector socket 40 are coupled with each other, the front metal shell 211 (referring to FIG. 4) of the shielding shell 21 of the plug 20 and the metal shell 41 of the socket 40 are connected with each other, thereby achieving complete shielding at the interfacing portion.

The connector plug 20 further comprises two fixing screws 22 used to fix the connector plug 20 to the socket 40, and the connector socket 40 further comprises two fixing nuts 42 for fixing the connector plug 20. When the screws 22 on the connector plug 20 are connected completely with the fixing nuts 42 on the connector socket 40, the connector plug 20 contacts completely with the connector socket 40, so as to achieve connection of electrical signal.

Figure 4:
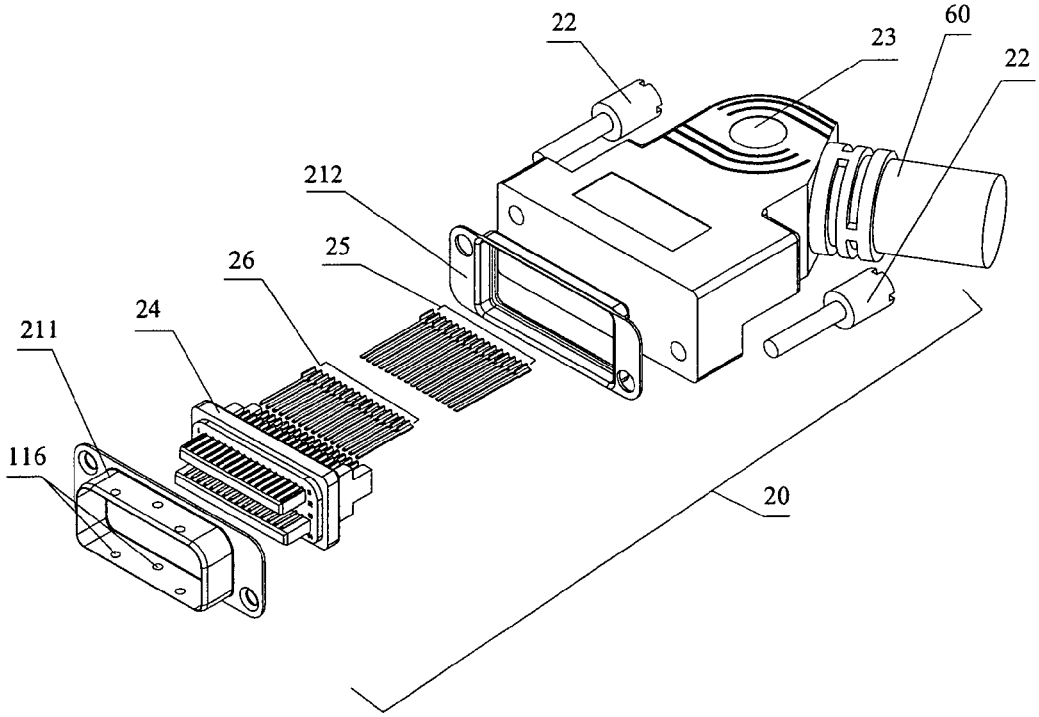
FIG. 4 is an exploded view of the high density connector plug according to an embodiment of the present invention.

As shown in FIG. 3 and FIG. 4, the high density connector plug 20 according to an embodiment of the present invention comprises the body of plug and a plastic enclosure 23 that is used to fix said body of plug and connect the cable. Said body of plug comprises shielding shell 21, insulator 24 mounted in said shielding shell 21, and a set of contacts provided on the side of said insulator 24. Said shielding shell 21 comprises front metal shell 211 and rear metal shell 212. Said front metal shell 211 matches with the metal shell 41 of the socket 40; said rear metal shell 212 is fixedly connected with the plastic enclosure 23, so that the entire body of plug is fixed on the plastic enclosure 23. Said set of contacts comprises a plurality of long contacts 25 and a plurality of short contacts 26; in this embodiment, there are 64 contacts (only 16 are shown in the figure; of course, an appropriate number of contacts may be designed as required).

Figure 5:
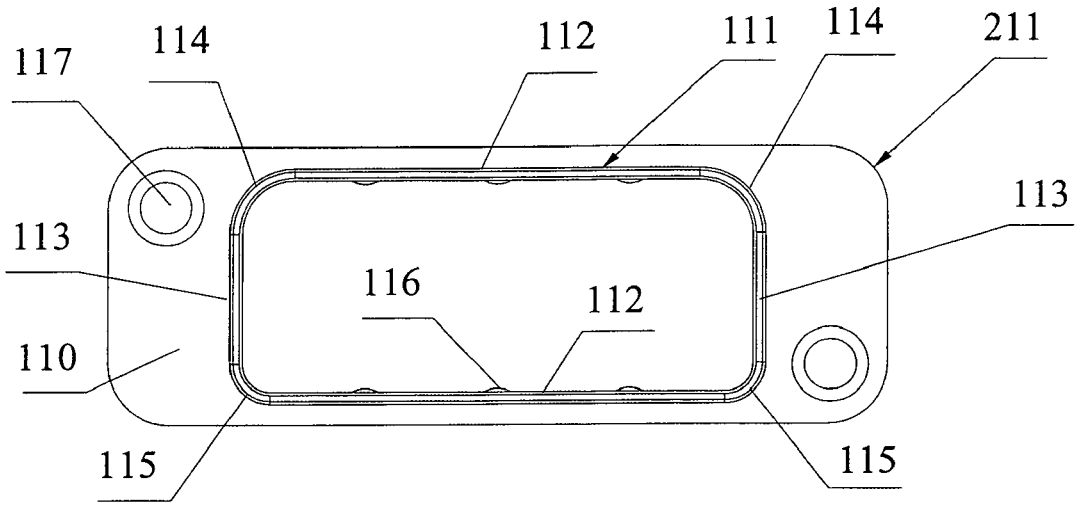
FIG. 5 is an end view of the front metal shell of the shielding shell of the high density connector plug according to an embodiment of the present invention.

As shown in FIG. 5, said front metal shell 211 is punched out on the metal shell base 110 and comprises two parts: a generally rectangular shielding shell 111 for plug interface, with four metal walls, two longitudinal sidewalls 112 and two lateral sidewalls 113, wherein the longitudinal sidewall 112 transits to the lateral sidewall 113 via a large round corner 114 or a small round corner 115; the radius of the large round corner 114 is different from that of the small round corner 115, so as to implement asymmetry of the shielding shell of the interface, in order to prevent misplugging when the connectors are coupled with each other; and some small round protrusions 116 may be provided at the inner wall of the longitudinal side wall 112, to ensure a certain retention force when the shielding shell of the plug interface and the shielding shell of the socket interface are coupled with each other; and two fixing screw holes 117, at both sides of the rectangular diagonal line of the shielding shell 111 of plug interface, and in the same size larger than the diameter of the fixing screws 22, for passing through the fixing screws 22.

Figure 6:
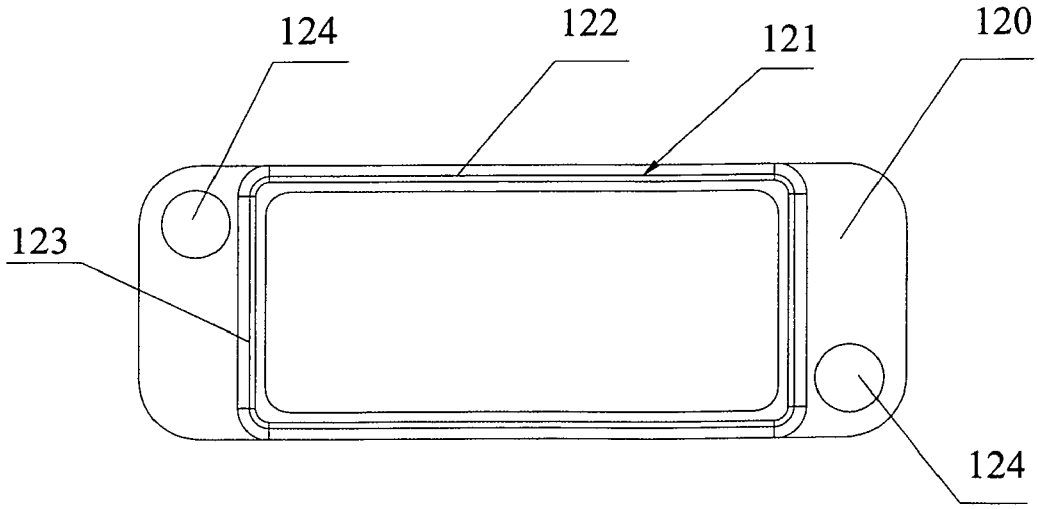
FIG. 6 is an end view of the rear metal shell of the shielding shell of the high density connector plug according to an embodiment of the present invention.

As shown in FIG. 6, said rear metal shell is punched out on the rear metal shell base 120 and comprises two parts: a rectangular shielding shell 121 for plug interface, with four metal walls, two longitudinal sidewalls 122 and two lateral sidewalls 123, wherein the longitudinal sidewall 122 transits to the lateral sidewall 123 via a round corner; and the rectangle matches the rear half part of the plastic insulator 24 of the plug in size, forming a rear metal shielding; and fixing screw holes 124, at both sides of the rectangular diagonal line of the shielding shell of plug interface, and in the same size larger than the diameter of the fixing screws, for passing through the fixing screws.

Figure 7:
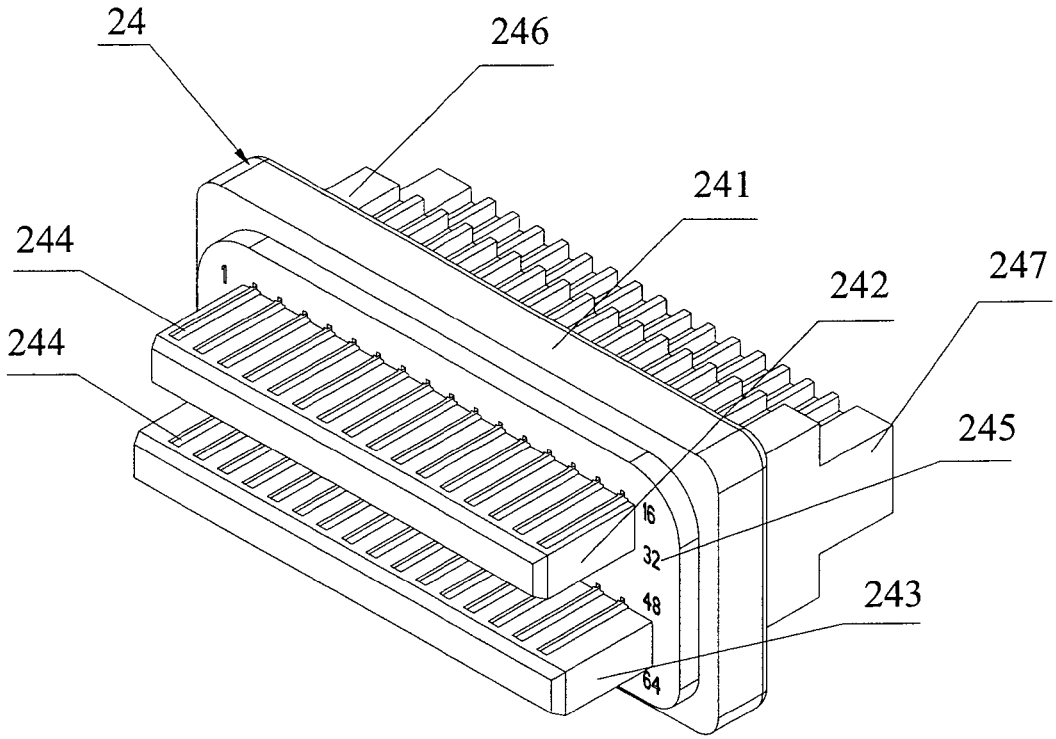
FIG. 7 is a stereogram of the insulator of the high density connector plug according to an embodiment of the present invention.
Figure 8:
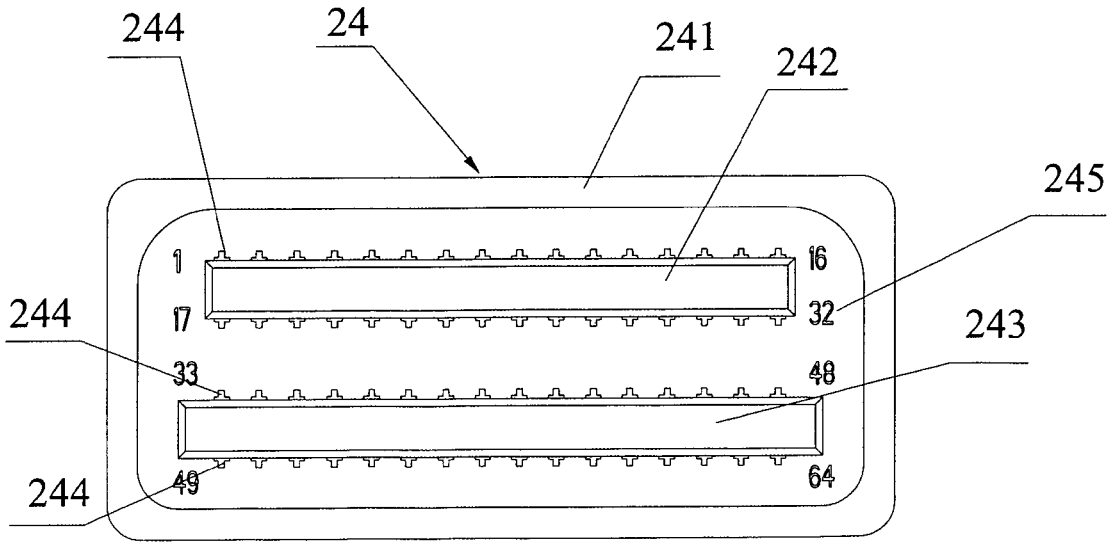
FIG. 8 is a front view of the insulator of the high density connector plug according to an embodiment of the present invention.

As shown in FIG. 7 and FIG. 8, said insulator 24 comprises a base 241, an upper plastic body 242 and a lower plastic body 243 extending outwards from one side of said base 241; there are slots 244 for mounting said contacts provided on the upper and lower surfaces of said upper plastic body 242 and lower plastic body 243. Said upper plastic body 242 is different from said lower plastic body 243 in length, but they are symmetric with reference to the center line thereof, respectively, in order to achieve the function of preventing misplugging; of course, said upper and lower plastic bodies can be in an asymmetric structure to prevent misplugging. There are 16 slots 244 of the same size distributed on each side of the upper plastic body 242, respectively, for mounting the contacts; also, there are 16 slots of the same size distributed on each side of the lower plastic body 243, respectively, for mounting the contacts; said base 241 is in a rectangular shape, with the four corners chamfered into round corners of different radius, in order to match the front metal shell 211 (as in FIG. 5) of the connector plug; and position data 245 for the metal contacts is labeled on said base 241, for reference during mounting.

Figure 9:
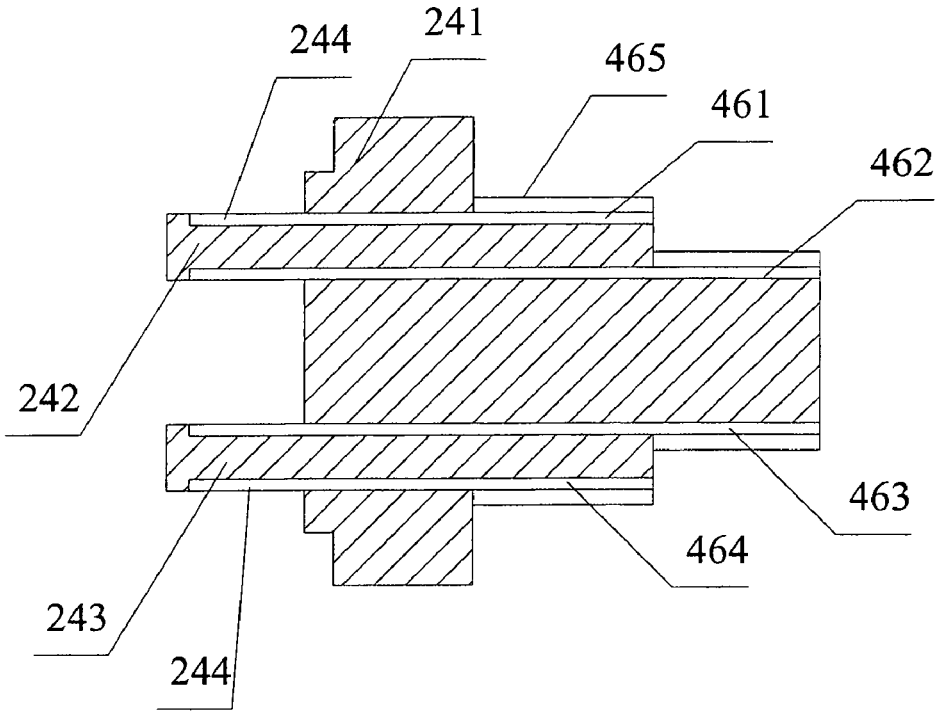
FIG. 9 is a sectional view of the insulator of the high density connector plug according to an embodiment of the present invention.

Said base 241 is in the stepped welding area extending outwards from the other side of said upper plastic body 242 and lower plastic body 243; there are mounting grooves provided on the surface of said welding area, communicating with the slots 244 at said upper plastic body 242 and lower plastic body 243. Said welding area comprises the first plastic body 246 extending outwards from said base 241 and the second plastic body 247 extending outwards from said first plastic body 246, provided in a stepped shape. As shown in FIG. 9, said mounting grooves comprise a plurality of first mounting grooves 461 provided on the upper surface of said first plastic body 246 and communicating with the slots 244 at the upper surface of said upper plastic body 242, a plurality of second mounting grooves 462 provided on the upper surface of said second plastic body 247 and communicating with the slots 244 at the lower surface of said upper plastic body 242, a plurality of third mounting grooves 463 provided on the lower surface of said second plastic body 247 and communicating with the slots 244 at the upper surface of said lower plastic body 243, and a plurality of fourth mounting grooves 464 provided on the lower surface of said first plastic body 246 and communicating with the slots 244 at the lower surface of said lower plastic body 243; there are insulating spacers 465 provided between said mounting grooves, respectively.

Figure 10:
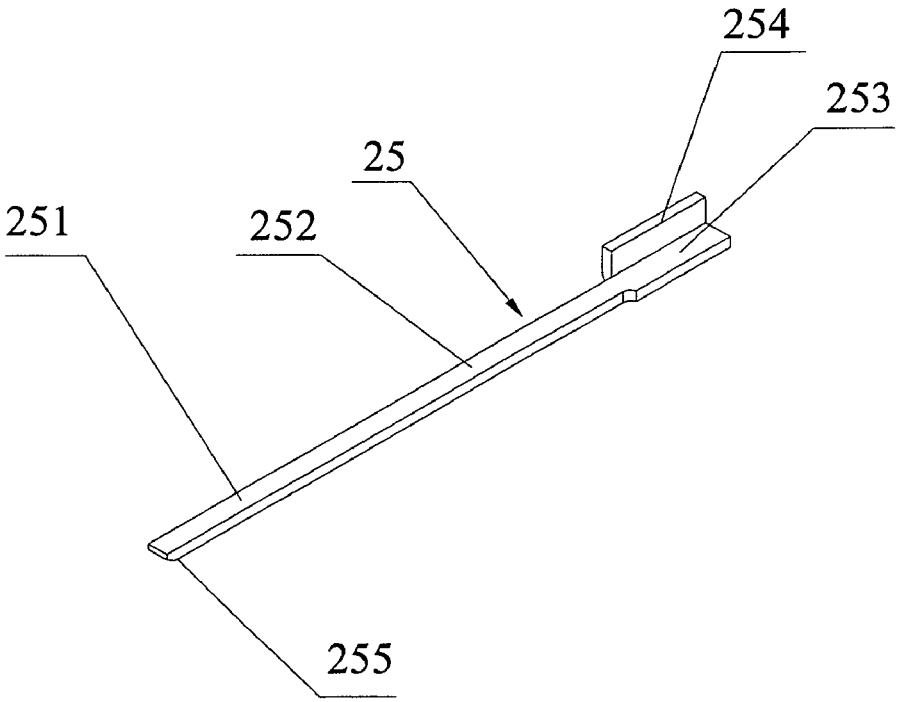
FIG. 10 is a stereogram of the long contacts of the high density connector plug according to an embodiment of the present invention.
Figure 16:
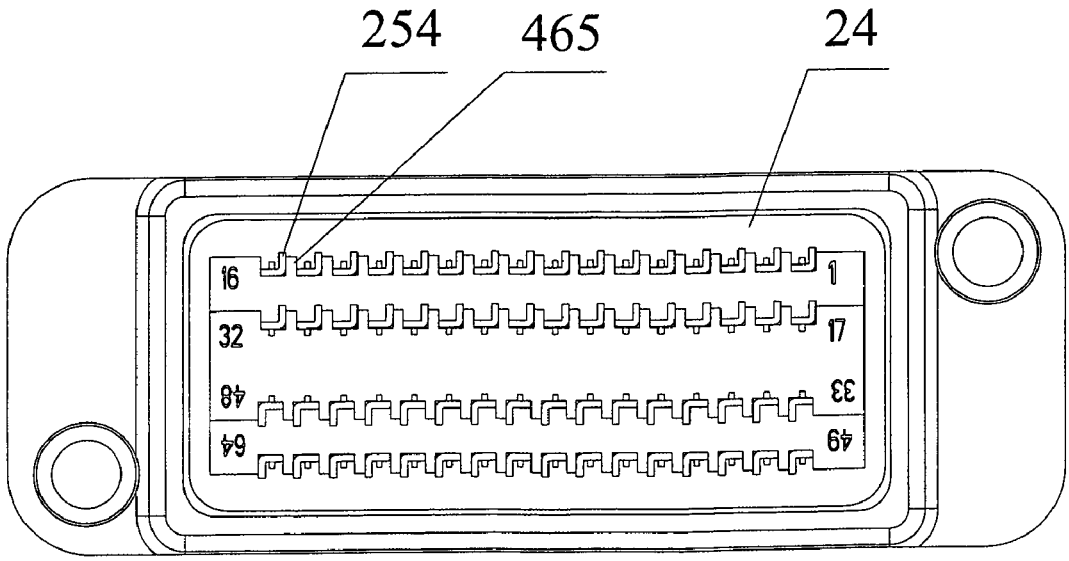
FIG. 16 is a rear view of the assembled high density connector plug according to an embodiment of the present invention.

As shown in FIG. 10, said long contact 25 comprises front contact portion 251 provided in a slot 244 at the lower surface of the upper plastic body 242 or the upper surface of the lower plastic body 243, middle portion 252 passing through the base of said insulator 24, welding portion 253 provided in a mounting grooves at said welding area, and flanged edge 254 extending upwards from a side of said welding portion 253. There is a guide chamfer 255 provided at the front end of the contact portion 251, designed to provide guide function when plug 20 is connected with socket 40, to facilitate fitting of plug 20 and socket 40. Said front contact portion 251 is designed to connect with the contact portion of socket 40, forming reliable electrical connection; the middle portion 252 of said contact is designed to match a slot on the plastic insulator 24 of the plug, in order to hold the contact in the insulator 24 stably; said welding portion 253 is designed to match the cable 60, the cable 60 being fixable to the contact by welding to establish electrical connection; said flanged edge 254 is higher than the insulating spacer 465 between the grooves for fixing metal contact in the insulator 24 (as shown in FIG. 16), for effectively blocking the solder from flowing across separate contacts during the pull-welding process.

Figure 11:
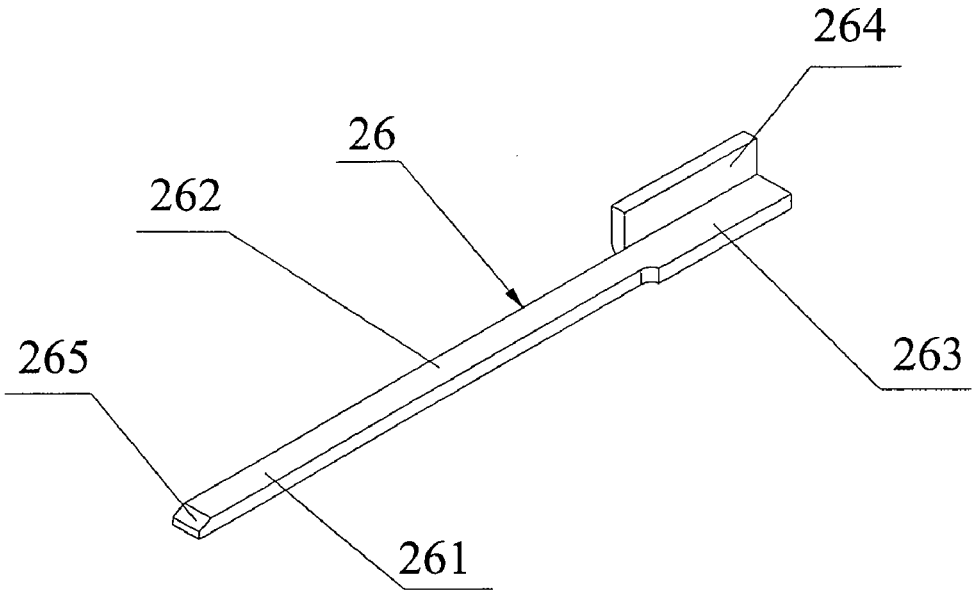
FIG. 11 is a stereogram of the short contacts of the high density connector plug according to an embodiment of the present invention.

As shown in FIG. 11, said short contact 26 is substantially in the same structure as said long contact and comprises front contact portion 261 in a slot 244 provided on the lower surface of the upper plastic body 242 or the upper surface of the lower plastic body 243, middle portion 262 passing through the base 241 of said insulator 24, welding portion 263 provided in a mounting groove at said welding area, and flanged edge 264 extending upwards from a side of said welding portion 263 and higher than said insulating spacer 465. And, there is a guide chamfer 265 provided at the front end of said contact portion 261. Compared to said long contact, the short contact is different in length of the middle portion, orientation of the chamfer, and slot for mounting.

Figure 12:
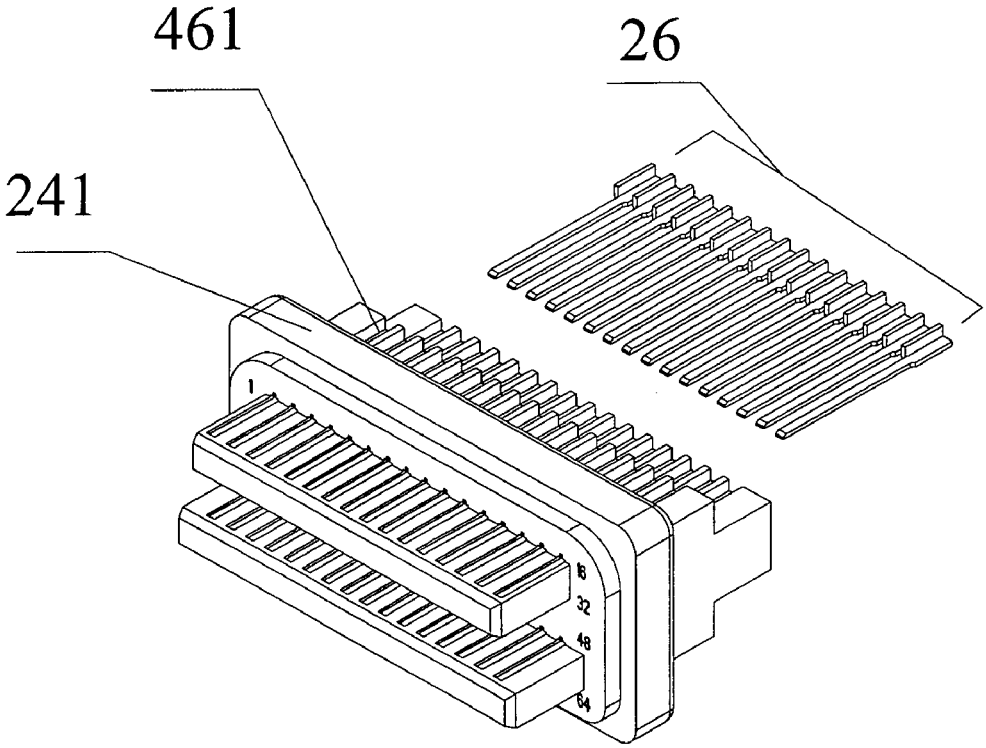
FIG. 12 is a schematic diagram of assembling of the short contacts with the insulator in the high density connector plug according to an embodiment of the present invention.

When the high density connector plug according to an embodiment of the present invention is assembled, first, as shown in FIG. 12, 16 short contacts 26 are arranged together according to the spacing between the first mounting grooves 461 in the welding area with a clamp, with the flanged edges 264 of the contacts arranged in the same orientation; then, the short contacts are pressed into said first mounting grooves 461 with an appropriate press-fit tool and reach the slots 244 at the upper surface of said upper plastic body 242 so as to be fixed.

Figure 13:
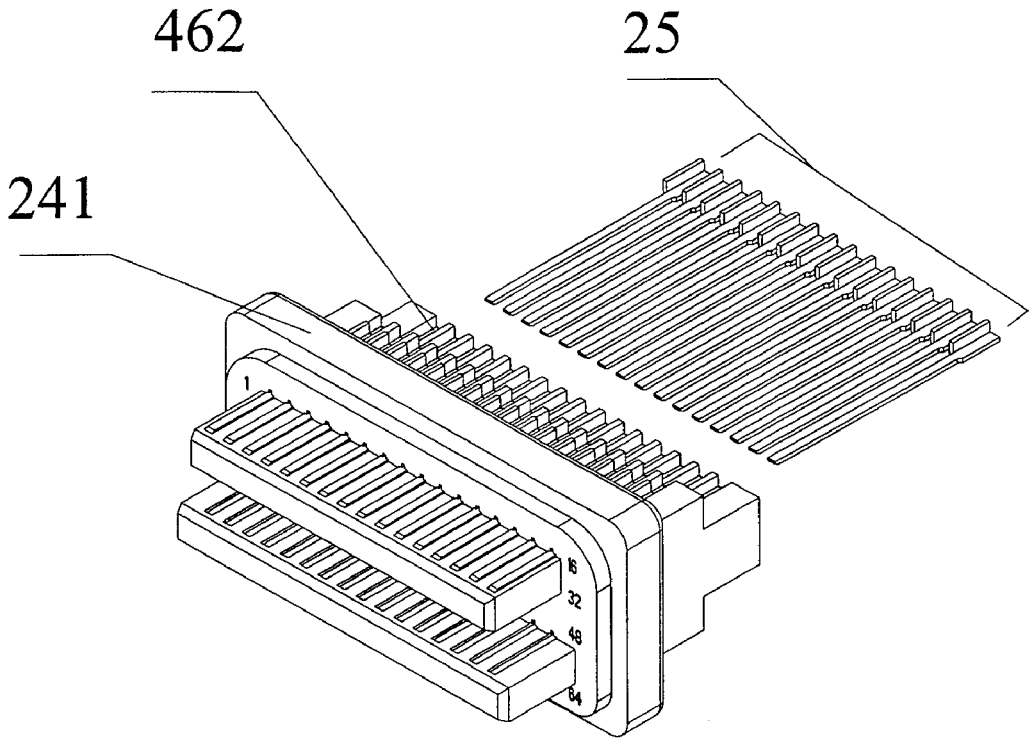
FIG. 13 is a schematic diagram of assembling of the long contacts with the insulator in the high density connector plug according to an embodiment of the present invention.

Next, as shown in FIG. 13, 16 long contacts 25 are arranged together according to the spacing between the second mounting grooves 462 in the welding area, with the flanged edges 254 of the contacts arranged in the same orientation; then, the long contacts 25 are pressed into said second mounting grooves 462 with an appropriate press-fit tool and reach the slots 244 at the lower surface of said upper plastic body 243 so as to be fixed.

Next, as shown in FIG. 12 again, 16 short contacts 26 are arranged together according to the spacing between the fourth mounting grooves 464 in the welding area, with the flanged edges 264 of the contacts arranged in the same orientation; then, the short contacts 26 are pressed into said fourth mounting grooves 464 with an appropriate press-fit tool and reach the slots 244 at the lower surface of said lower plastic body 243 so as to be fixed.

Next, as shown in FIG. 13 again, 16 long contacts 25 are arranged together according to the spacing between the third mounting grooves 463 in the welding area, with the flanged edges 254 of the contacts arranged in the same orientation; then, the long contacts 25 are pressed into said third mounting grooves 463 with an appropriate press-fit tool and reach the slots at the upper surface of said lower plastic body 243.

Figure 14:
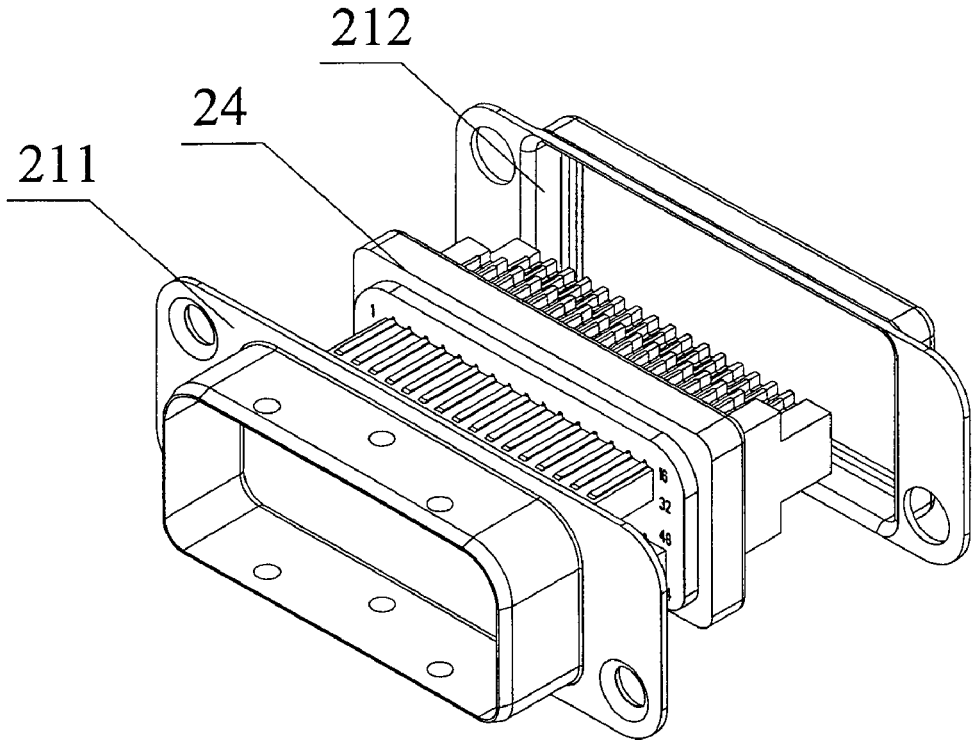
FIG. 14 is a schematic diagram of assembling of the insulator and the shielding shell in the high density connector plug according to an embodiment of the present invention.
Figure 15:
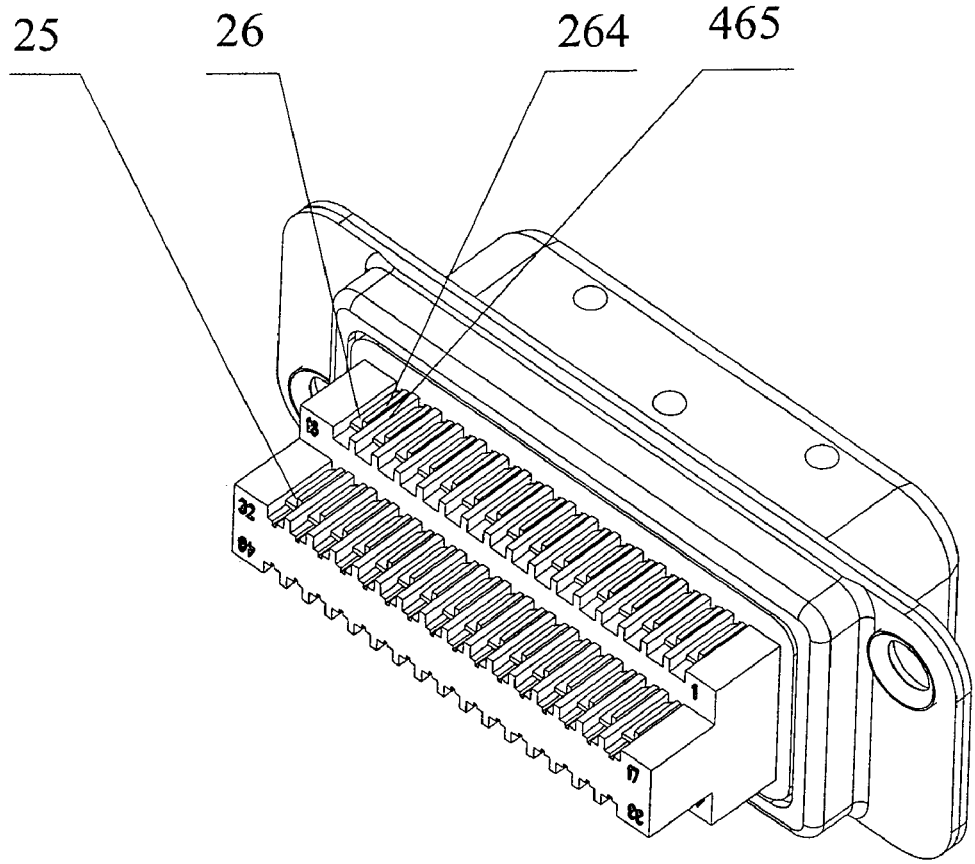
FIG. 15 is a stereogram of the assembled high density connector plug according to an embodiment of the present invention.

Next, as shown in FIG. 14, the front metal shell 211, the insulator 24 with 64 contacts 25 and 26, and the rear metal shell 212 are assembled together, and then the screw holes in both of the metal shells are riveted together, to complete the assembling of the connector plug; the assembled connector plug is shown in FIGS. 15 and 16.

Through providing the upper plastic body and the lower plastic body on the insulator for mounting contacts, the present invention reduces the spacing therebetween with a little increase in width, resulting in reduced footprint of connector interface and increased pin density. In a 64-Pin connector, for example, with the same number of contacts, the interface footprint is reduced from 512.9 $mm^2$ (98.43 mm×15.37 mm) to 554.8 $mm^2$ (38 mm×14.6 mm), i.e., reduced to about ⅓. Meanwhile, the pin density of the contacts is increased from 47.28 $mm^2$/2 Pins to 16.27 $mm^2$/2 Pins, i.e. increased to almost 3 times. Reduced interface footprint and increased pin density reduce the volume of the corresponding device, so that the devices have a trend towards miniature and high density.

In addition, there is a stepped welding area on the insulator, so that the contacts can be connected to the cable by welding, and, in conjunction with the pull-welding processing method, quick manual welding of multi-core cable is achieved; and the cable welding is made visible, thereby the working efficiency can be improved; the design of long and short contacts facilitates quick assembling in the insulator; the flanged edge design of the contacts and the welding area, in conjunction with the pull-welding process, is advantageous to improve welding efficiency and prevent the solder from flowing; and since the flanged edges of the contacts are arranged in the same orientation, the insulating clearance between contacts is increased effectively, and thereby the insulating strength of the connector is increased.

The invention claimed is:

1. An electrical connector, comprising the body of plug and an enclosure for fixing said body of plug and being connected with the cable, wherein:

said body of plug comprises a shielding shell, an insulator mounted in said shielding shell, and a set of contacts provided on the side of said insulator;

said insulator comprises a base and upper plastic body and lower plastic body extending outwards from one side of said base;

slots for mounting said contacts are provided on the upper and lower surfaces of said upper plastic body and lower plastic body respectively;

said insulator also comprises a stepped welding area extending outwards from the other side of said base;

there are mounting grooves communicating with the slots at said upper plastic body and lower plastic body, provided on the surface of said welding area;

said welding area has a first plastic body extending outwards from said base and a second plastic body extending outwards from said first plastic body, provided in a stepped-shape;

said mounting grooves comprise a plurality of first mounting grooves provided on the upper surface of said first plastic body and communicating with the slots at the upper surface of said upper plastic body, a plurality of second mounting grooves provided on the upper surface of said second plastic body and communicating with the slots at the lower surface of said upper plastic body, a plurality of third mounting grooves provided on the lower surface of said second plastic body and communicating with the slots at the upper surface of said lower plastic body, and a plurality of fourth mounting grooves provided on the lower surface of said first plastic body and communicating with the slots at the lower surface of said lower plastic body; there are insulating spacers provided between said mounting grooves, respectively;

said set of contacts comprise a plurality of short contacts mounted in said first mounting grooves and fourth mounting grooves; and said short contact comprises front contact portion provided in a slot at the upper surface of said upper plastic body or the lower surface of said lower plastic body, middle portion passing through the base of said insulator, welding portion provided in a mounting groove at said welding area, and flanged edge extending upwards from a side of said welding portion and higher than said insulating spacer;

the flanged edges of said plurality of short contacts mounted in said first mounting grooves are arranged in the same orientation;

the flanged edges of said plurality of short contacts mounted in said fourth mounting grooves are arranged in the same orientation.

2. The electrical connector according to claim 1, wherein the contact portion of said short contact has a guide chamfer at its front end.

3. The electrical connector according to claim 1, wherein said set of contacts further comprise a plurality of long contacts mounted in said second mounting grooves and third mounting grooves.

4. An electrical connector, comprising the body of plug and an enclosure for fixing said body of plug and being connected with the cable, wherein said body of plug comprises a shielding shell, an insulator mounted in said shielding shell, and a set of contacts provided on the side of said insulator;

said insulator comprises a base and upper plastic body and lower plastic body extending outwards from one side of said base;

slots for mounting said contacts are provided on the upper and lower surfaces of said upper plastic body and lower plastic body respectively;

said insulator also comprises a stepped welding area extending outwards from the other side of said base;

there are mounting grooves communicating with the slots at said upper plastic body and lower plastic body, provided on the surface of said welding area;

said welding area has a first plastic body extending outwards from said base and a second plastic body extending outwards from said first plastic body, provided in a stepped-shape;

said mounting grooves comprise a plurality of first mounting grooves provided on the upper surface of said first plastic body and communicating with the slots at the upper surface of said upper plastic body, a plurality of second mounting grooves provided on the upper surface of said second plastic body and communicating with the slots at the lower surface of said upper plastic body, a plurality of third mounting grooves provided on the lower surface of said second plastic body and communicating with the slots at the upper surface of said lower plastic body, and a plurality of fourth mounting grooves provided on the lower surface of said first plastic body and communicating with the slots at the lower surface of said lower plastic body;

there are insulating spacers provided between said mounting grooves, respectively;

said set of contacts comprise a plurality of long contacts mounted in said second mounting grooves and third mounting grooves; and said long contact comprises front contact portion provided in a slot at the lower surface of said upper plastic body or the upper surface of said lower plastic body, middle portion passing through the base of said insulator, welding portion provided in a mounting groove at said welding area, and flanged edge extending upwards from a side of said welding portion;

the flanged edges of said plurality of long contacts mounted in said second mounting grooves are arranged in the same orientation;

the flanged edges of said plurality of long contacts mounted in said third mounting grooves are arranged in the same orientation.

5. The electrical connector according to claim 4, wherein the contact portion of said long contact has a guide chamfer at its front end.

6. The electrical connector according to claim 4, wherein said set of contacts further comprise a plurality of short contacts mounted in said first mounting grooves and fourth mounting grooves.

7. The electrical connector according to claim 6, wherein said short contact comprises front contact portion provided in a slot at the upper surface of said upper plastic body or the lower surface of said lower plastic body, middle portion passing through the base of said insulator, welding portion provided in a mounting groove at said welding area, and flanged edge extending upwards from a side of said welding portion and higher than said insulating spacer;

the flanged edges of said plurality of short contacts mounted in said first mounting grooves are arranged in the same orientation;

the flanged edges of said plurality of short contacts mounted in said fourth mounting grooves are arranged in the same orientation.

8. An electrical connector, comprising the body of plug and an enclosure for fixing said body of plug and being connected with the cable, wherein:

said body of plug comprises a shielding shell, an insulator mounted in said shielding shell, and a set of contacts provided on the side of said insulator;

said insulator comprises a base and upper plastic body and lower plastic body extending outwards from one side of said base;

slots for mounting said contacts are provided on the upper and lower surfaces of said upper plastic body and lower plastic body respectively; and said upper plastic body is shorter than said lower plastic body, and said upper plastic body and the lower plastic body are in symmetry with reference to the center line, respectively.

9. The electrical connector according to claim 8, wherein:

said shielding shell comprises a rear metal shell mounted in said enclosure and a front metal shell provided at the front end of said enclosure; and said front metal shell has a round protrusion provided on its inner wall.

* * * * *